US007100773B2

(12) United States Patent
Craven et al.

(10) Patent No.: US 7,100,773 B2
(45) Date of Patent: Sep. 5, 2006

(54) PRODUCT PACKAGING WITH DISPLAY

(75) Inventors: Arnold R. Craven, Chicopee, MA (US); Carl A. Chasse, Stafford, CT (US)

(73) Assignee: Phillips Screw Company, Wakefield, MA (US)

( * ) Notice: Subject to any disclaimer, the term of this patent is extended or adjusted under 35 U.S.C. 154(b) by 0 days.

(21) Appl. No.: 09/949,607

(22) Filed: Sep. 12, 2001

(65) Prior Publication Data

US 2003/0047484 A1 Mar. 13, 2003

(51) Int. Cl.
*B65D 23/12* (2006.01)
*B65D 85/24* (2006.01)

(52) U.S. Cl. ..... 206/734; 206/732; 206/338

(58) Field of Classification Search ..... 206/230, 206/231, 338, 477, 480, 730–735, 206, 340, 206/341; 229/103.1; 220/735
See application file for complete search history.

(56) References Cited

U.S. PATENT DOCUMENTS

| | | | | | |
|---|---|---|---|---|---|
| 35,201 | A | * | 5/1862 | Mason | 206/734 |
| 1,492,113 | A | | 4/1924 | Welsh | |
| 1,844,189 | A | * | 2/1932 | Stuart | 206/734 |
| 1,858,461 | A | | 5/1932 | Raster | |
| 1,946,808 | A | * | 2/1934 | Peirce | 206/231 |
| 2,018,861 | A | * | 10/1935 | Mertz | 206/488 |
| 2,210,385 | A | | 8/1940 | Salfisberg | |
| 2,219,183 | A | * | 10/1940 | Hartnett et al. | 206/733 |
| 3,095,677 | A | * | 7/1963 | Dreyfus et al. | 206/338 |
| 3,666,087 | A | | 5/1972 | Cooper | |
| 3,679,093 | A | * | 7/1972 | Chang | 220/90.2 |
| 3,822,783 | A | | 7/1974 | Mortensen | |
| 3,874,554 | A | * | 4/1975 | Chang | 220/90.2 |
| 3,948,391 | A | | 4/1976 | Beaman | |
| 3,966,083 | A | * | 6/1976 | Hoffman et al. | 220/833 |
| 4,005,776 | A | * | 2/1977 | Seeley | 206/306 |
| 4,062,449 | A | | 12/1977 | Popkes et al. | |
| 4,244,378 | A | * | 1/1981 | Brignola | 600/579 |
| 4,260,057 | A | | 4/1981 | Wall-Andersen | |
| 4,586,615 | A | | 5/1986 | Quitmann | |
| 4,619,364 | A | | 10/1986 | Czopor, Jr. | |

(Continued)

FOREIGN PATENT DOCUMENTS

DE 299 00 982 U 7/2000

(Continued)

OTHER PUBLICATIONS

European Patent Office, International Search Report, Apr. 3, 2003.

*Primary Examiner*—Mickey Yu
*Assistant Examiner*—J. Gregory Pickett
(74) *Attorney, Agent, or Firm*—Dickstein Shapiro LLP

(57) ABSTRACT

A package for a plurality of products, having a closed container having a container wall, the wall defining a cavity for holding the products, and the wall having a product holder adapted to hold at least one selected product in a position visible from outside the container. The holder is an inwardly and/or outwardly opening recess formed in the wall, and the at least one selected product is positioned in the recess. The holder includes an outer member restraining the selected product to the outwardly opening recess, such as a packaging label, having a transparent portion forming a viewing window for viewing the selected product. In yet another aspect, the plurality of products in the cavity may be identical primary products, such as screws. The selected product may be different from the primary product, such as a driver bit for driving the screws.

21 Claims, 3 Drawing Sheets

U.S. PATENT DOCUMENTS

| | | | | | |
|---|---|---|---|---|---|
| 4,927,021 | A | * | 5/1990 | Taylor | 206/373 |
| 5,071,005 | A | | 12/1991 | Hemmings et al. | |
| 5,080,225 | A | * | 1/1992 | Russo et al. | 206/204 |
| 5,178,354 | A | | 1/1993 | Engvall | |
| 5,209,354 | A | * | 5/1993 | Thornhill et al. | 206/469 |
| 5,240,110 | A | | 8/1993 | Reichenbach, III et al. | |
| 5,375,700 | A | * | 12/1994 | Joss et al. | 206/734 |
| 5,957,286 | A | * | 9/1999 | Ho | 206/373 |
| 2003/0106821 | A1 | * | 6/2003 | Bar-Erez | 206/373 |

FOREIGN PATENT DOCUMENTS

| | | | |
|---|---|---|---|
| DE | 100 20 433 | C | 6/2001 |
| FR | 1 093 214 | A | 5/1955 |
| FR | 1 406 513 | A | 7/1965 |
| FR | 2 700 755 | A | 1/1994 |
| NL | 1 000 900 | C | 1/1997 |

* cited by examiner

PRODUCT PACKAGING WITH DISPLAY

BACKGROUND

The present invention relates generally to product containers. In particular, the present invention relates to a container for primary products that displays a sample of the primary product or displays a companion product for use with the primary product.

Fastener products, such as screws, are commonly sold in packages containing a quantity of products, which could be as many as up to one hundred or more. Some packages of screws also include a companion product, such as driver bit that is sized to fit the screws. However, without first opening the package, the purchaser may not be able to see the driver bit to ensure its presence. What is needed is a package that allows the purchaser to see the driver bit or other companion product without first opening the package.

SUMMARY

The present inventions provide a package for a plurality of products, having a closed container having a container wall, the wall defining a cavity for holding the products, and the wall having a product holder adapted to hold at least one selected product in a position visible from outside the container.

In one aspect the holder is an outwardly opening recess formed in said wall, and the at least one selected product is positioned in the recess.

In another aspect, the holder includes an outer member restraining the selected product to the recess. In one embodiment, the outer member is a packaging label, having a transparent portion forming a viewing window for viewing the selected product.

In yet another aspect, the plurality of products in the cavity are identical primary products, and the at least one selected product includes at least one secondary product, different from the primary product.

In another aspect, the primary products are screws and the at least one selected product includes a driver bit for driving the screws.

In another aspect, the screws are wood screws and the at least one selected product includes a drill bit for drilling a pilot hole for the screws.

These and other features and advantages of the invention will be more clearly understood from the following detailed description and drawings of preferred embodiments of the present invention.

DETAILED DESCRIPTION OF PREFERRED EMBODIMENTS

Figure 1:
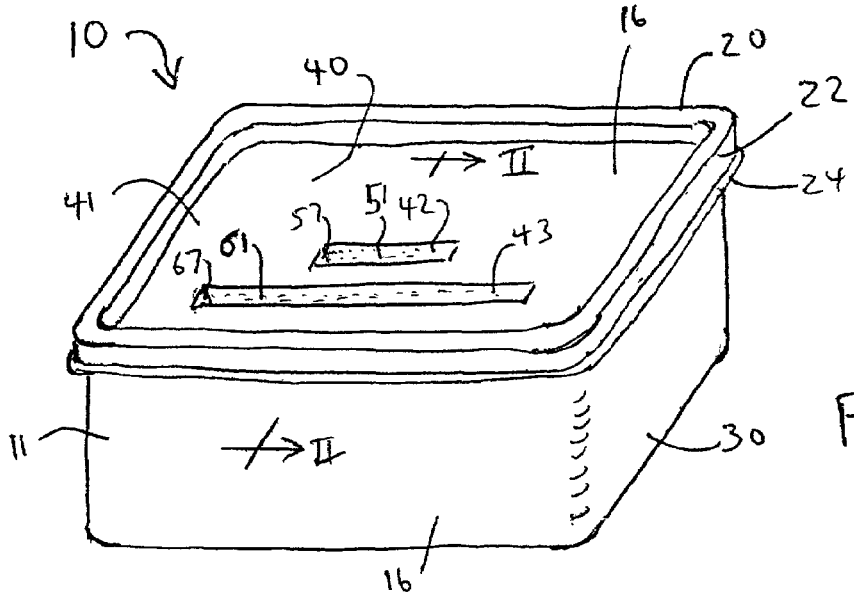
FIG. 1 is a perspective view of a package according to a preferred embodiment of the present invention.
Figure 2:
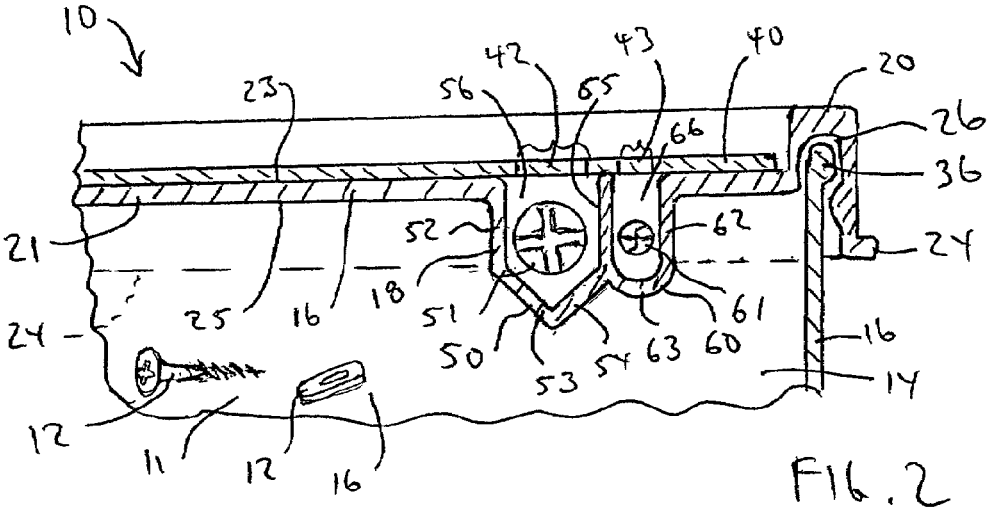
FIG. 2 is a partial cross-sectional view taken along line II—II of FIG. 1.
Figure 3:
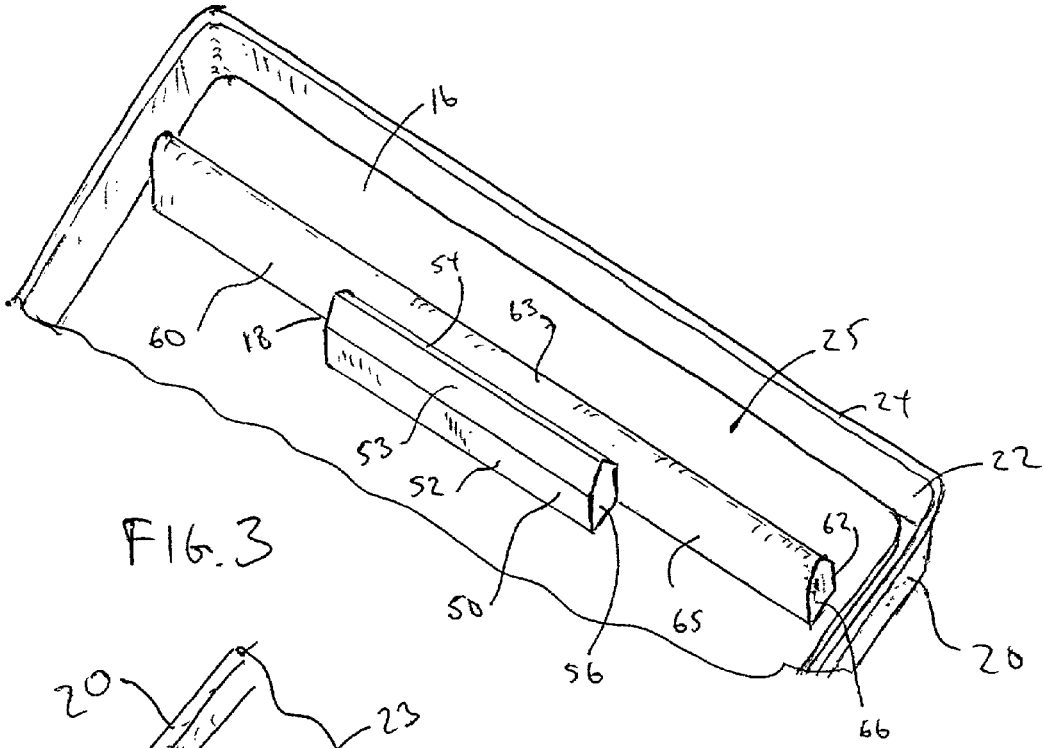
FIG. 3 is a perspective view of a portion of the inside of the lid of the package of FIG. 1.
Figure 4:
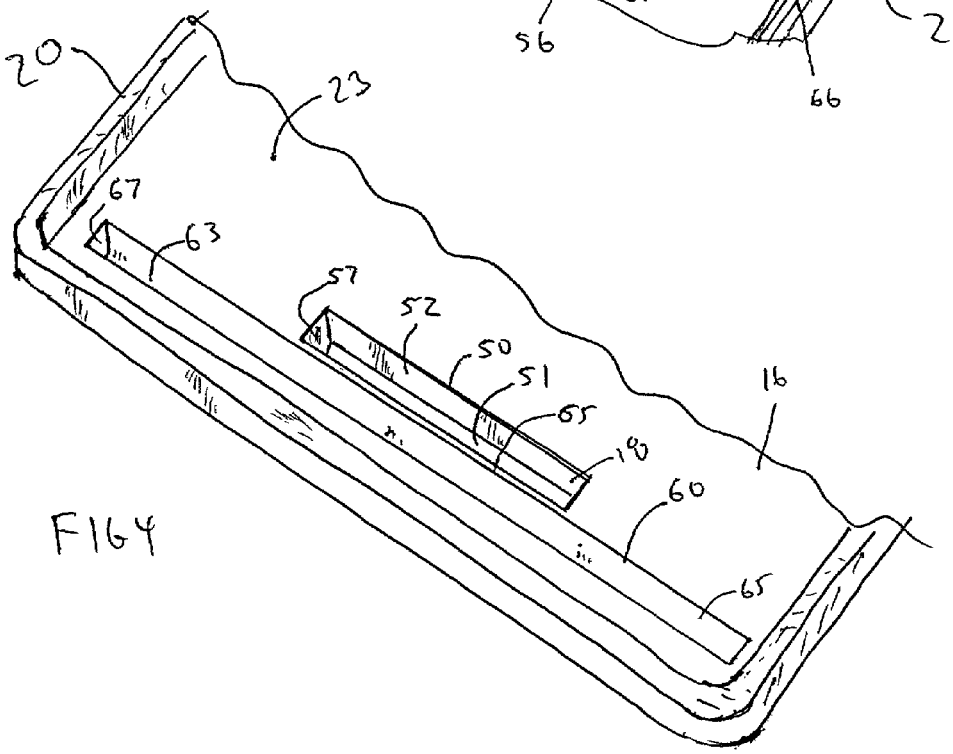
FIG. 4 is a perspective view of a portion of the outside of the lid of the package of FIG. 1.

Refer now to FIGS. 1 through 4, there being shown a package, generally designated by reference numeral 10, according to a preferred embodiment of the present invention. The package 10 includes a container 11 having base portion 30 and a lid portion 20. The container lid portion 20 and base portion 30 have container walls 16 that define a container cavity 14. Within the container cavity 14 the package 10 includes a number of primary products 12. The base 30 is open at the top. The container lid 20 is held onto the container base 30 by friction or interference fit between the channel 26 and the lid rim 22 and the edge 36 of the base 30. When the lid 20 is assembled to the base 30, the primary products 12 are contained within the cavity 14. The rim lip 24 provides additional surface area for grasping the lid 20 for its removal from the base 30.

The package 10 also includes at least one selected product that is held in a position visible from outside the package 10. In the illustrated embodiment there are two selected products 51 and 61. A holder 18 is provided on the container wall 16 lid 20 to hold the selected products 51 and 61 in position visible from outside the container 11. Alternatively, the holder 18 may be provided on any portion of the container wall 16. The package 10 also includes a label 40 adhered to the outer surface 23 of the lid wall 21. The label 40 is a film material and has transparent windows 42 and 43 positioned to allow viewing of the selected products 51 and 61 from outside the package. The label 40 has information regions 41, on which information may be placed regarding the package such as product specifications, instructions for the use of the products, the manufacturer and supplier information product names, and the like. Alternatively, the entire label 40 may be substantially transparent.

The holder 18 extends inwardly into the cavity 14 of the container 11. The holder 18 of the illustrated embodiment includes a recess 50 and a recess 60 each sized to hold a respective selected product 51 and 61. The holder also includes the label 40 that restricts the selected products to the respective recesses 50 and 60. In the illustrated embodiment the primary product 12 includes a plurality of wood screw fasteners and washers sized to be used with the screws. The selected product 51 is a driver bit for use for driving the wood screws and the selected product 61 is a drill bit for drilling pilot holes for the screws 12. As shown in the illustrated embodiment the wood screws have a cruciform recess and the driver bit 51 has a complimentary cruciform shape for driving the screw 12, such as PHILLIPS® brand cross tip drivers and cross head screws. Other configurations for the complimentary products may be used. For example, the primary products could include bolts and the selected products could include hex head drivers. Other primary products could include different lengths of screws and could include various other products. In one arrangement for package 10, all of the primary products 12 are identical wood screws and the package includes a plurality of primary products, such as five, ten, fifty, one hundred or more and, generally, the primary products are loosely, or more tightly, packaged together within the single undivided container cavity 14 defined by the wall 16. However there could be one or more sub-cavities separated by dividers.

The recesses 50 and 60 of the product holder 18 are each sized to hold their respective product thus the recess 60 is longer and narrower than the recess 50. This is because the drill bit 61 is longer and narrower than the driver bit 51. Also, the contour of the recess 50 is slightly different from that of the recess 60. The recess 60 has a curved inner wall 63 and straight side walls 62 and 65. The recess 50 has a straight side wall 52 and straight inner walls 53 and 54. Moreover, the recess 50 shares a portion of the side wall 65 with the recess 60. This configuration provides strength for the lid 20 and is suitable for molding from plastic material. The recesses 50 and 60 also have end walls 56 and 57, and 66 and 67, respectively.

Figure 5:
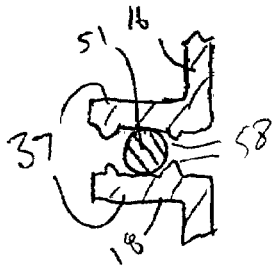
FIGS. 5 through 8 are partial cross-sectional views showing alternate preferred embodiments.
Figure 6:
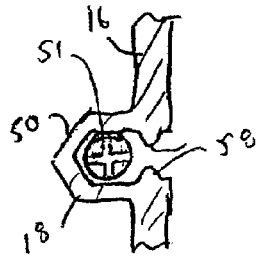
Figure 7:
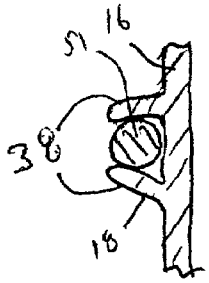
Figure 8:
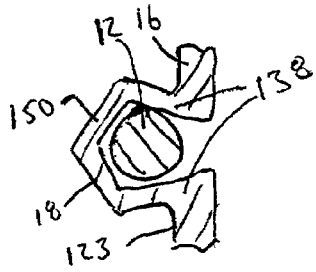

Refer now to FIGS. 5 through 8 which show alternate embodiments of the holder 18 according to the present invention. FIG. 5 illustrates a holder 18 that opens both to the inside and outside of the wall 16 and includes protrusions 58 on holder walls 37 for holding the selected product 51 and 61 in the recess by friction. FIG. 6 illustrates another alternate embodiment similar to the recess 50 of FIG. 2 but also including the protrusions 58 for holding the driver bit 51 in the recess 50 by friction. FIG. 7 illustrates another alternate embodiment wherein the wall 16 is transparent and the holder 18 includes a pair of walls 38 that are angled to hold the secondary product 51 by friction. And, FIG. 8 illustrates another alternate embodiment wherein the holder 18 includes a recess 150 opening to the inside of the container and extending outwardly from the wall surface 123 of the wall 16 of the container. The side walls 138 of the recess 150 are angled to hold in the primary product 12 by friction. The walls are flexible enough to allow the selected product to be inserted and removed past the friction or interference structure.

The above description and drawings are only illustrative of preferred embodiments of the present inventions, and are not intended to limit the present inventions thereto. Any subject matter or modification thereof which comes within the spirit and scope of the following claims is to be considered part of the present inventions.

What is claimed as new and desired to be protected by Letters Patent of the United States is:

1. A package having a plurality of primary products, comprising a closed container having a container wall, said wall defining a cavity holding the primary products loosely in bulk, and said wall having a removable lid having a product holder on an interior surface thereof, said product holder holding at least one selected product, that is not held in bulk in said cavity, in a position visible from outside the container, wherein at least one or more of said at least one selected product is complementary to said primary products, and wherein said plurality of primary products are fasteners and said at least one selected product is a driver bit.

2. A package as in claim 1 wherein said holder comprises an outwardly opening recess formed in said wall, said at least one selected product being positioned in said recess.

3. A package as in claim 2 wherein said recess is sized to hold said at least one selected product by friction.

4. A package as in claim 2 wherein said holder includes an outer member restraining said at least one selected product to said recess.

5. A package as in claim 4 wherein said outer member is a film layer.

6. A package as in claim 5 wherein said film layer is a packaging label, having a transparent portion forming a viewing window for viewing said at least one selected product.

7. A package as in claim 1 wherein said plurality of primary products in said cavity are identical primary products.

8. A package as in claim 7 wherein said product holder is also adapted to hold at least one primary product.

9. A package as in claim 1 wherein said fasteners are screws.

10. A package as in claim 9 wherein said screws are wood screws.

11. A package as in claim 9 wherein said driver bit is for driving said screws.

12. A package as in claim 9 wherein said screws are cross head screws and said driver bit has a cross tip for mating with said cross head screws.

13. A package as in claim 9 wherein said screws are wood screws and said at least one selected product includes a drill bit for drilling a pilot hole for said screws.

14. A package as in claim 1 wherein said holder comprises an inwardly opening recess formed in said wall, said at least one selected product being positioned in said recess.

15. A package as in claim 14 wherein said recess is sized to hold said at least one selected product by friction.

16. A package as in claim 1 wherein said container includes a base and wherein said removable lid is adapted to engage said base to close said container.

17. A package as in claim 1 wherein said cavity for holding the plurality of primary products is undivided forming a single section for holding the plurality of primary products.

18. A package containing a plurality of products, comprising a closed container having a container wall, said wall defining a cavity holding the products in bulk, and a lid having a product holder holding a selected one of the products in a position separate from said plurality of products and visible from outside the container, wherein said product holder holds said selected product by friction, said plurality of products are fasteners and wherein said selected one of the products is a drill bit for drilling pilot holes for said fasteners.

19. A package containing a plurality of products, comprising a container having a container wall defining at least one cavity holding said products in bulk, and a container lid operable to expose said products, said lid having a product holder holding a complimentary product, different from said plurality of products and not held in bulk in said cavity, separate from said plurality of products in a position visible from outside the container, wherein said complimentary product is a driver bit having a tip, and at least one of said plurality of products is a screw having a recess, and wherein said tip is engageable with said recess.

20. A package containing a plurality of products, comprising a container having a container wall defining at least one cavity holding said products in bulk, and a container lid operable to expose said products, said lid having a product holder holding a complimentary product, different from said plurality of products and not held in bulk in said cavity, separate from said plurality of products in a position visible from outside the container, wherein said complimentary product is a drill bit, and at least one of said plurality of products is a screw.

21. A package containing a plurality of primary products, comprising a closed container having a container wall, said wall defining a cavity holding the plurality of primary products loosely in bulk, and a lid having a product holder holding a complimentary product in a position visible from outside the container and separate from said plurality of primary products, wherein said complimentary product is held in said product holder by a substantially transparent material, and wherein said complimentary product is a drill bit, and at least one of said plurality of primary products is a screw.

* * * * *